US008936450B2

(12) United States Patent
Izawa et al.

(10) Patent No.: US 8,936,450 B2
(45) Date of Patent: Jan. 20, 2015

(54) ROOTS FLUID MACHINE WITH REDUCED GAS LEAKAGE

(75) Inventors: Yuya Izawa, Kariya (JP); Shinya Yamamoto, Kariya (JP); Takashi Ban, Kariya (JP); Takayuki Imai, Kariya (JP); Katsumi Yamashita, Kariya (JP); Yasunaka Hanaoka, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 795 days.

(21) Appl. No.: 13/180,873

(22) Filed: Jul. 12, 2011

(65) Prior Publication Data

US 2012/0014825 A1 Jan. 19, 2012

(30) Foreign Application Priority Data

Jul. 14, 2010 (JP) ..... 2010-159389

(51) Int. Cl.

| | |
|---|---|
| ***F04C 18/08*** | (2006.01) |
| ***F04C 18/18*** | (2006.01) |
| ***F04C 18/12*** | (2006.01) |
| ***F04C 27/00*** | (2006.01) |
| ***F04C 29/12*** | (2006.01) |

(52) U.S. Cl.

CPC ..... *F04C 18/084* (2013.01); *F04C 18/086* (2013.01); *F04C 18/126* (2013.01); *F04C 27/006* (2013.01); *F04C 29/122* (2013.01)

USPC ..... 418/77; 418/75; 418/79; 418/80; 418/205

(58) Field of Classification Search

CPC .... F04C 18/084; F04C 18/086; F04C 27/006; F04C 18/18

USPC ..... 418/9, 10, 205, 206.4, 206.5, 75, 77, 418/78, 79, 157, 189

See application file for complete search history.

(56) References Cited

U.S. PATENT DOCUMENTS

| | | | | |
|---|---|---|---|---|
| 1,451,859 | A * | 4/1923 | Balcker | 418/77 |
| 1,795,579 | A * | 3/1931 | Storey | 418/77 |
| 3,296,974 | A * | 1/1967 | Johansson | 418/205 |
| 5,944,501 | A | 8/1999 | Yokoi | |
| 7,618,247 | B1 * | 11/2009 | Niemiec | 418/79 |
| 2005/0089424 | A1 * | 4/2005 | Liu et al. | 417/445 |

FOREIGN PATENT DOCUMENTS

| | | | |
|---|---|---|---|
| JP | 2884067 | 4/1999 | |
| JP | 2000-213481 | 8/2000 | |
| JP | 2003-097452 | 4/2003 | |
| JP | 2004-270545 | 9/2004 | |
| JP | 2004270545 A * | 9/2004 | F04C 18/18 |

* cited by examiner

*Primary Examiner* — Mary A Davis

(74) *Attorney, Agent, or Firm* — Baker & Hostetler LLP

(57) ABSTRACT

A roots type fluid machine includes a case having a side wall, a pair of rotary shafts provided in the case, a pair of rotors engaged with each other and fixed to the pair of rotary shafts so as to extend axially, respectively, a suction space formed by the case and the pair of rotors for introducing fluid, a discharge space formed by the case for discharging fluid and the pair of rotors and a transfer chamber formed by the case and the rotor. The rotor has a rotor end surface. A clearance is formed between the side wall and the rotor end surface. The transfer chamber transfers gas introduced in the suction space to the discharge space in accordance with the rotation of the pair of rotors. The case has a guide groove formed in the side wall facing the rotor end surface. Gas leaked from the discharge space into the clearance is introduced to the transfer chamber through the guide groove.

7 Claims, 16 Drawing Sheets

ROOTS FLUID MACHINE WITH REDUCED GAS LEAKAGE

CROSS REFERENCE TO RELATED APPLICATIONS

This application claims priority to Japanese Patent Application No.2010-159389 filed Jul. 14, 2010.

BACKGROUND

The present invention relates to a roots type fluid machine for transferring fluid by rotating a rotor.

A roots type pump (or roots type fluid machine) is widely used for a blower and a vacuum pump. A single stage roots pump shown in FIGS. 15, 16 has a pair of rotors 101A, 101B fixedly mounted on rotary shafts 102, 103 in a case 100, respectively. The rotor 101A is rotated by a drive gear (not shown) fixed on the rotary shaft 102 and the other rotor 101B is rotated in synchronization with the rotor 101A by the rotation of a driven gear (not shown) engaged with the drive gear. The pair of rotors 101A, 101B rotates synchronously in opposite directions with their lobes engaged with each other. Gas introduced through an inlet 105 by the synchronous rotation of the paired rotors 101A, 101B is trapped in a transfer chamber 110 formed by the case 100 and the rotors 101A, 101B. The gas is transferred from the inlet 105 to an outlet 106 of the roots pump in accordance with the rotation of the rotors 101A, 101B. Subsequently, the gas is released, e.g., by a later stage subsidiary pump.

Japanese Patent Publication NO. 2884067 discloses a roots type blower having a zigzag shaped groove formed in the inner wall of the blower case at a position adjacent to the blower outlet. When air flows back from the outlet, the zigzag groove decreases the air-flow velocity gradually while the air is flowing through the zigzag groove thereby to decrease the noise generated during the operation of the blower.

The roots type pump disclosed by the Japanese Patent Publication NO. 2884067 and shown in FIGS. 15 and 16 has clearances with predetermined dimensions (0.1-0.3 mm) between the rotors 101A and 101B and also between the case 100 and the respective rotors 101A, 101B. The roots type pump is configured so that the rotors 101A, 101B rotate while keeping the respective clearances. Since there is a pressure difference between the inlet 105 and the outlet 106 of the roots type pump, gas leaks through the clearances. Specifically, in the transfer chambers 110 formed by the case 100 and the respective rotors 101A, 101B of the roots type pump, gas leaks through the clearance formed along an inner wall 100A of the case 100 between the inner wall 100A and the respective rotor outer surfaces 101AA, 101BA, as indicated by arrow B in FIG. 15, and also through the clearance A formed in axial direction of the rotary shafts 102, 103 between a side wall 100B of the case 100 and the respective rotor end surfaces 101AB, 101BB, as indicated by arrow C in FIG. 16. The leakage through the clearance A connecting directly the outlet 106 on high-pressure side of the roots type pump and the inlet 105 on low pressure side thereof is a main factor for reducing the pump efficiency and hence causing an increase of power consumption.

The present invention is directed to providing a roots type fluid machine which can reduce the gas leakage through a clearance in axial direction of its rotary shaft between the discharge space and the suction space.

SUMMARY

A roots type fluid machine includes a case having a side wall, a pair of rotary shafts provided in the case, a pair of rotors engaged with each other and fixed to the pair of rotary shafts so as to extend axially, respectively, a suction space formed by the case and the pair of rotors for introducing fluid, a discharge space formed by the case for discharging fluid and the pair of rotors and a transfer chamber formed by the case and the rotor. The rotor has a rotor end surface. A clearance is formed between the side wall and the rotor end surface. The transfer chamber transfers gas introduced in the suction space to the discharge space in accordance with the rotation of the pair of rotors. The case has a guide groove formed in the side wall facing the rotor end surface. Gas leaked from the discharge space into the clearance is introduced to the transfer chamber through the guide groove.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF ILLUSTRATIVE EMBODIMENTS

Figure 1:
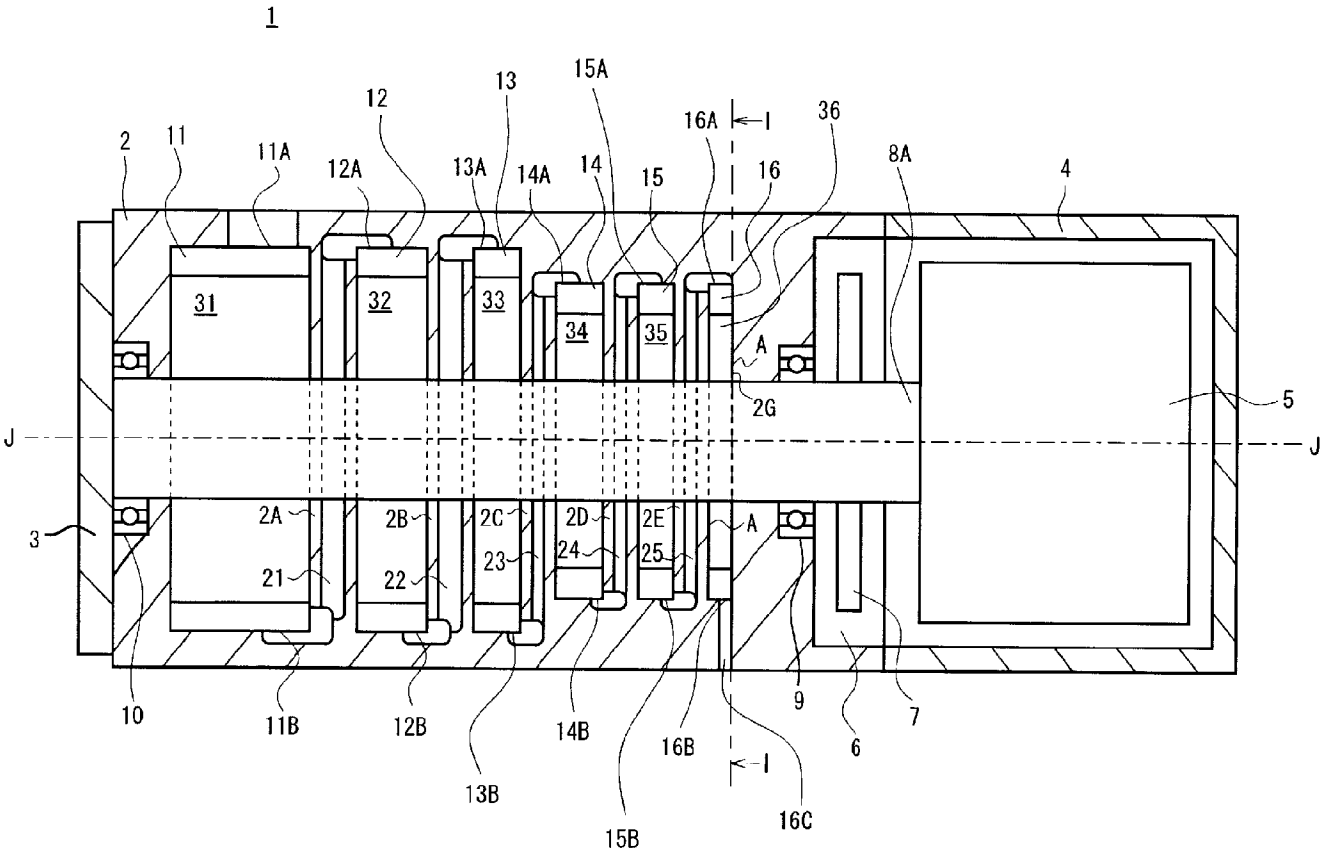
FIG. 1 is a cross-sectional view of a roots type pump according to a first embodiment of the present invention.

The following will describe the roots type pump as a roots type fluid machine according to the first embodiment with reference to accompanying drawings. As shown in FIG. 1, the multi-stage roots pump according to the first embodiment is designated generally by numeral 1. The roots type pump 1 includes a case 2, a front plate 3 joined to one end surface of the case 2, a motor case 4 joined to the other end surface of the case 2 and an electric motor 5 housed in the motor case 4 for driving the roots type pump 1.

The case 2 forms therein on the motor case 4 side thereof a gear case 6 that houses a drive gear 7 and a driven gear (not shown). The drive gear 7 and the driven gear are disposed in the gear case 6 in engagement with each other for transmitting rotational power.

The electric motor 5 and the drive gear 7 are connected to a rotary shaft 8A. The rotary shaft 8A is rotatably supported at one end thereof by a radial bearing 9 fitted in the case 2 on the gear case 6 side of the case 2 and at the other end thereof by another radial bearing 10 provided in the case 2 and facing the front plate 3.

The case 2 has formed therein partition walls 2A, 2B, 2C, 2D, 2E located in this order as viewed from the front plate 3 and first through sixth pump chambers 11, 12, 13, 14, 15, 16 separated from one another by the partition walls 2A-2E. Volumes of the first through sixth pump chambers 11-16 are decreased progressively from the first pump chamber 11 toward the sixth pump chamber 16. Inlets 11A, 12A, 13A, 14A, 15A, 16A for introducing gas and outlets 11B, 12B, 13B, 14B, 15B, 16B for discharging gas are formed in the first through sixth pump chambers 11-16, respectively. The inlet 11A of the first pump chamber 11 forms an inlet port for introducing gas from the exterior and the outlet 16B of the sixth pump chamber 16 is connected to a discharge passage 16C for discharging gas to the exterior. The outlet 11B of the first pump chamber 11 is connected to the inlet 12A of the second pump chamber 12 through a passage 21 and similarly, the outlets 12B-15B of the second through fifth pump chambers 12-15 are connected to the inlets 13A-16A of the third through sixth pump chambers 13-16 through passages 22-25, respectively.

A rotary shaft 8B (see FIG. 2) is provided in parallel relation to the rotary shaft 8A in the case 2. The rotary shafts 8A, 8B pass through the partition walls 2A-2E and the first through the sixth pump chambers 11-16. Six pairs of rotors 31-36 are fixedly mounted on the rotary shafts 8A, 8B so as to extend axially for rotation therewith at respective positions corresponding to the first through sixth pump chambers 11-16. The rotary shafts 8A, 8B are rotated synchronously in opposite directions by the rotation of the drive and driven gears. Accordingly, the respective pairs of rotors 31-36 are rotated synchronously in opposite directions in the respective pump chambers 11-16. Each of the rotors 31-36 has three lobes, a rotor outer surface at the outer periphery of the rotors 31-36 and rotor end surfaces at the axial ends of the rotors 31-36 in the axial direction.

Figure 2:
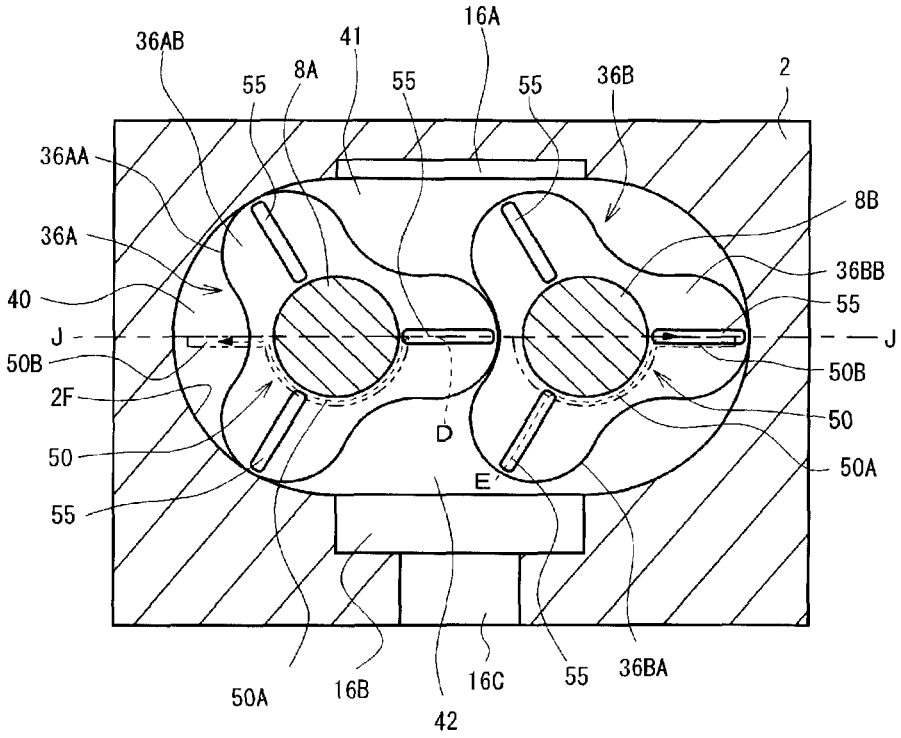
FIG. 2 is a cross-sectional view that is taken along the line I-I in FIG. 1.

The following will describe the sixth pump chamber 16 shown in FIG. 2 in details. The inlet 16A is formed in upper part of the case 2 for introducing therethrough gas discharged from the fifth pump chamber 15 and flowing through a passage 25 into the sixth pump chamber 16. The outlet 16B is formed in lower part of the case 2 for discharging therethrough gas transferred from the sixth pump chamber 16. The outlet 16B is connected to the discharge passage 16C. The paired rotors 36 are composed of the rotor 36A fixed on the rotary shaft 8A on the driving side and the rotor 36B fixed on the rotary shaft 8B on the driven side. The rotors 36A, 36B are supported so that the rotor outer surfaces 36AA, 36BA of the respective rotors 36A, 36B are located very close to the inner wall 2F of the case 2 with a minimal clearance formed between the respective rotor outer surfaces 36AA, 36BA and the inner wall 2F of the case 2. In FIG. 2, the rotors 36A, 36B are positioned such that a transfer chamber 40 is formed between the rotor outer surface 36AA and the inner wall 2F. In this case, the transfer chamber 40 is separated from suction space 41 and also from the discharge space 42. That is, the transfer chamber 40 is configured in accordance with the rotation of the rotors 36A, 36B such that a space between the rotors 36A, 36B and the case 2 is separated from the suction space 41 and the discharge space 42 to be the transfer chamber 40. The paired rotors 36A, 36B are engaged with each other in the sixth pump chamber 16 with a minimal clearance formed substantially at the center of the pump chamber 16 between the rotor outer surfaces 36AA, 36BA of the rotors 36A, 36B so that direct fluid communication between the suction space 41 on the inlet 16A side and the discharge space 42 on the outlet 16B side of the sixth pump chamber 16 is prevented. The suction space 41 is formed on the inlet 16A side of the sixth pump chamber 16 by the inlet 16A, the rotors 36A, 36B and the case 2, and the discharge space 42 is formed on the outlet 16B side of the sixth pump chamber 16 by the outlet 16B, the rotors 36A, 36B and the case 2.

Figure 15:
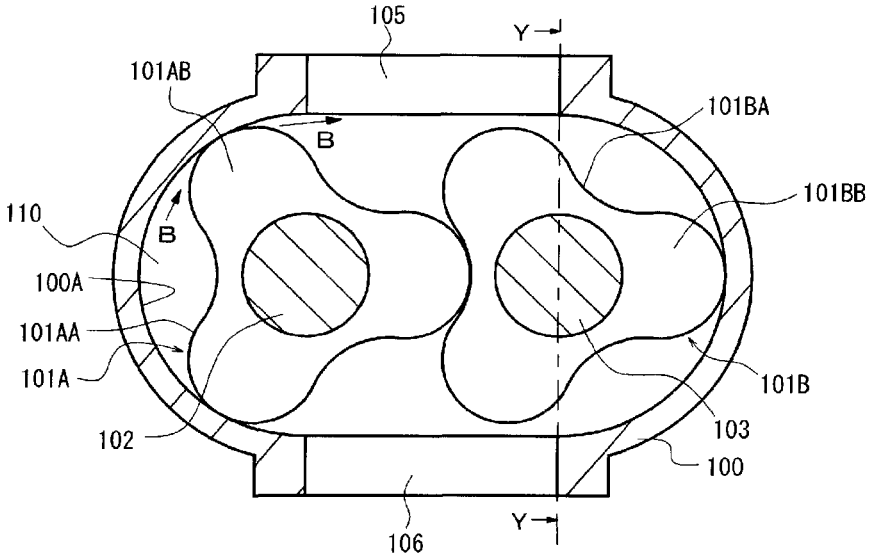
FIG. 15 is a cross-sectional view of a roots type pump according to prior art.
Figure 16:
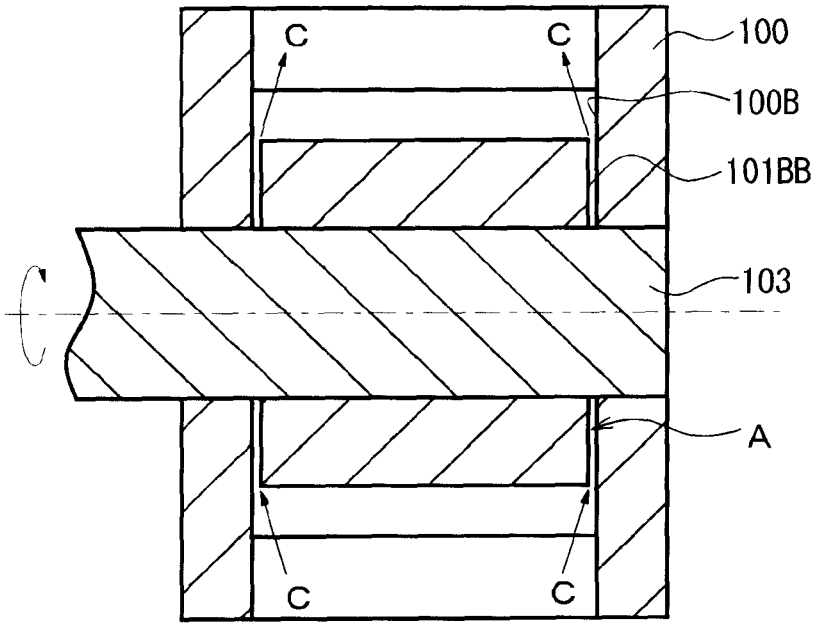
FIG. 16 is a cross-sectional view that is taken along the line Y-Y in FIG. 15.

Like the roots pump of prior art shown in FIGS. 15, 16, the roots type pump 1 of the present invention has a clearance A formed in axial direction of the rotary shafts 8A, 8B. In other words, the minimal clearance A in the axial direction of the rotary shafts 8A, 8B exists between the rotor end surfaces 36AB, 36BB of the rotors 36A, 36B on the electric motor 5 side of the sixth pump chamber 16 and the inner wall 2F of the case 2, specifically the side wall 2G (FIG. 1) of the case 2 facing the rotor end surfaces 36AB, 36BB. A minimal clearance in the axial direction of the rotary shafts 8A, 8B also exists between the other rotor end surface of the rotors 36A, 36B on the fifth pump chamber 15 side of the sixth pump chamber 16 and the other side wall of the case 2 (i.e., the side wall on partition wall 2E side of the sixth pump chamber 16). Similarly, the end surfaces of the respective rotors 31-35 and their corresponding side walls of the case 2 (or partition walls 2A-2E) form therebetween minimal clearances in the axial direction of the rotary shafts 8A, 8B in the first through fifth pump chambers 11-15. Thus, the provision of the minimal clearances between the rotor outer surfaces 36AA, 36BA and the inner walls 2F of the case 2 and the clearances A in the axial direction of the rotary shafts 8A, 8B prevents the respective pairs of rotors 31-36 and the case 2 from contacting each other, thereby allowing the pairs of rotors 31-36 to rotate without lubricating oil.

Guide grooves 50 are formed in the side wall 2G of the case 2 at positions facing the rotor end surfaces 36AB, 36BB, wherein the positions facing the rotor end surfaces 36AB, 36BB mean positions that are located on the inner wall 2F of the case 2 within the circles described by the radially outermost point of the respective rotor end surfaces 36AB, 36BB when the rotors are rotated. The guide grooves 50 are formed below the axes of the respective rotary shafts 8A, 8B on the discharge space side of the sixth pump chamber 16 (or below line J-J in FIG. 2) and include a semicircular arcuate groove 50A having a curvature along outer periphery of the respective rotary shafts 8A, 8B and a radial groove 50B extending from the outer periphery of the respective rotary shafts 8A, 8B in a radial and horizontal direction toward the inner wall 2F of the case 2. The radial groove 50B and the arcuate groove 50A are connected to each other at respective one ends thereof. The case 2 is divided into upper and lower parts at an imaginary horizontal plane (indicated by line J-J in FIG. 2) including the axes of the rotary shafts 8A, 8B. The upper and lower parts are combined together in a manner that the rotary shafts 8A, 8B and the rotors 31-36 are disposed in the lower part and that the upper part is mounted to the lower part. The guide groove 50 whose cross section is arcuate-shaped may be formed in the lower part of the case 2 by ball-end milling before mounting the upper part on the lower part. As shown in FIG. 2, a part of the radial groove 50B on the rotor 36A side of the sixth pump chamber 16 extends to a position facing the transfer chamber 40 so that the clearance A communicates with the transfer chamber 40.

Communication grooves 55 are formed at the center of the rotor end surfaces 36AB, 36BB of the respective lobes of the paired rotors 36 in a manner to extend radially from positions near the outer periphery of the rotary shafts 8A, 8B to positions near the respective outer lobe ends of the rotors 36. Referring to FIG. 2, the communication groove 55 is formed so as to face a part of the semicircular arcuate groove 50A near base portion of the lobe, i.e., the outer periphery of the respective rotary shafts 8A, 8B for communicating with the arcuate groove 50A. However, the communication grooves 55 are closed at the opposite radially outer ends thereof and not open to the rotor outer surfaces 36AA, 36BA for preventing leakage through the communication grooves 55. Referring to the rotor 36A in FIG. 2, the guide groove 50 (or the semicircular arcuate groove 50A and the radial groove 50B) and the communication groove 55 of the rotor 36A communicate with the transfer chamber 40.

The above has been described for one of the rotor end surfaces 36AB, 36BB of the rotors 36 in the sixth pump chamber 16 and the side wall 2G. Similar guide grooves and communication grooves are formed for the other rotor end surfaces of the rotors 36 and their opposed side wall of the case 2, respectively. Such guide grooves and communication grooves may be formed in the first through fifth pump chambers 11-15 in the same manner.

The following will describe the operation of the roots type pump 1 according to the first embodiment. When the electric motor 5 is driven, the rotary shaft 8A that is connected to the electric motor 5 rotates in the roots type pump 1. In accordance with the rotation of the rotary shaft 8A, the drive gear 7 rotates and transmits the rotational power to the driven gear. The drive gear 7 and the driven gear rotate synchronously and the rotary shaft 8B that is connected to the driven gear rotates thereby to rotate the respective pairs of the rotors 31-36 synchronously in the first through sixth pump chambers 11-16.

In accordance with the synchronous rotation of the rotary shafts 8A, 8B and the pairs of rotors 31-36 in the first through sixth pump chambers 11-16, gas is introduced into the first pump chamber 11 through the inlet 11A. Then, gas is transferred to the first pump chamber 11 and discharged into the outlet 11B. The gas in the outlet 11B is transferred and introduced into the inlet 12A of the second pump chamber 12 through the passage 21, transferred into the second pump chamber 12 and discharged to the outlet 12B. Subsequently, gas is transferred into the third through sixth pump chambers 13-16 through the passages 22-25, respectively, and discharged to the exterior from the outlet 16B of the sixth pump chamber 16 through the discharge passage 16C.

Figure 3:
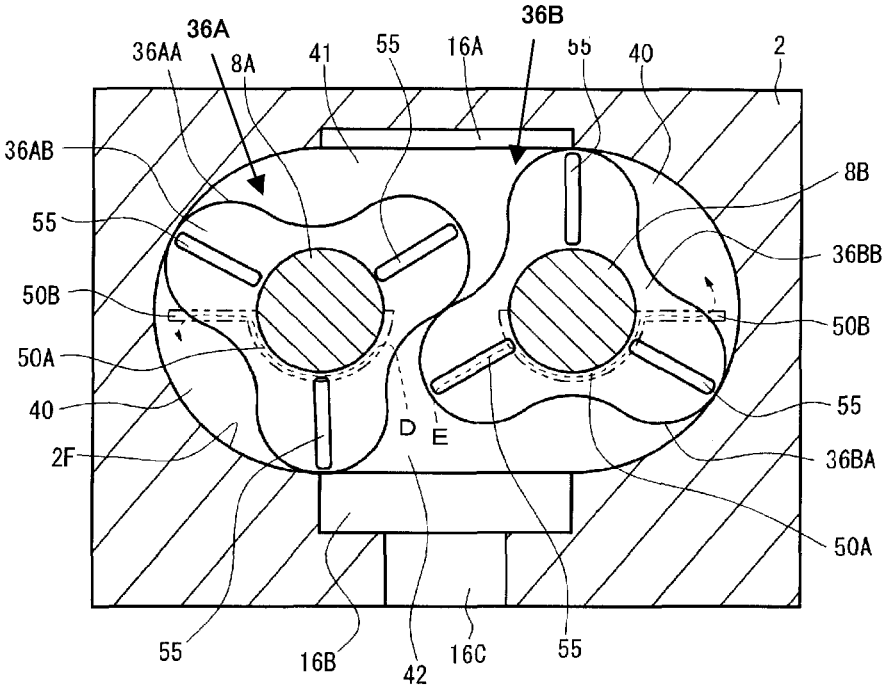
FIG. 3 is a cross-sectional view showing a state of the roots type pump of FIG. 1 after the rotor 36 has rotated 30 degrees from the state of FIG. 2.
Figure 4:
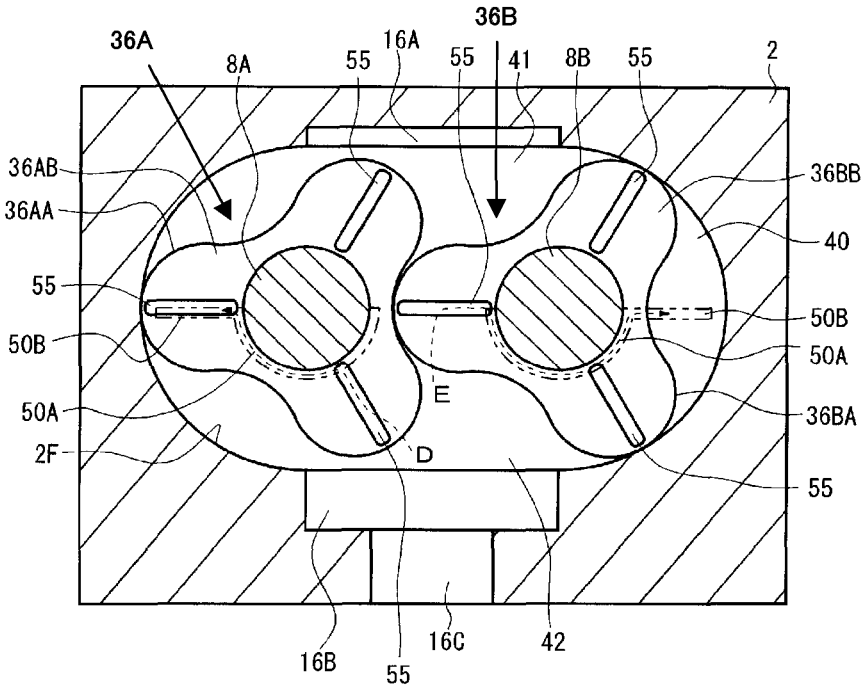
FIG. 4 is a cross-sectional view showing a state of the roots type pump of FIG. 1 after the rotor 36 has rotated 60 degrees from the state of FIG. 2.
Figure 5:
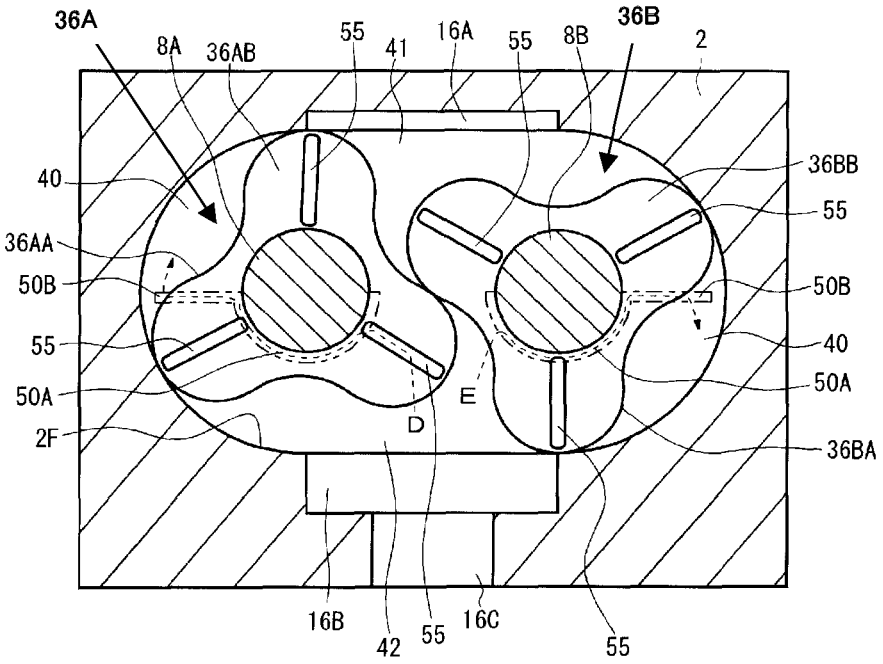
FIG. 5 is a cross-sectional view showing a state of the roots type pump of FIG. 1 after the rotor 36 has rotated 90 degrees from the state of FIG. 2.

The following will describe gas transfer in the sixth pump chamber 16. The rotor 36A rotates in the counterclockwise direction and the rotor 36B rotates in the clockwise direction in the sixth pump chamber 16 as viewed in FIG. 2. FIG. 3 shows the state of the rotors 36A, 36B after rotating 30 degrees from the state of FIG. 2. FIG. 4 shows the state of the rotors 36A, 36B after rotating 30 degrees from the state of FIG. 3. FIG. 5 shows the state of the rotors 36A, 36B after rotating 30 degrees from the state of FIG. 4. Referring to FIGS. 2 and 3, the transfer chamber 40 that is formed and enclosed by the rotor outer surface 36AA of the rotor 36A and the inner wall 2F of the case 2 is transferred toward the discharge space 42 in accordance with the rotation of the rotor 36A. In the rotation state of the rotor 36A shown in FIG. 4, the transfer chamber 40 completely communicates with the discharge space 42 and the gas in the transfer chamber 40 is discharged into the discharge space 42. When the lobe of the rotor 36A that is located near the suction space 41 in FIG. 4 rotates to a position close to the inner wall 2F as shown in FIG. 5, the rotor outer surface 36AA and the inner wall 2F of the case 2 cooperate to form therebetween a transfer chamber 40. Gas then present in the suction space 41 is introduced into the transfer chamber 40. In accordance with the rotation of the rotor 36A, the transfer chamber 40 is transferred to the positions shown in FIGS. 2, 3 successively thereby to transfer the gas toward the discharge space 42. Similarly, in accordance with the rotation of the rotor 36B of the sixth pump chamber 16, the transfer chamber 40 is formed, thereby introducing gas in the suction space 41 into the transfer chamber 40 and transferring the gas to the discharge space 42 in the same manner as described above with reference to the rotor 36A.

The following will describe how the reduction of gas leakage through the clearance A formed in the axial direction of the respective rotary shafts 8A, 8B is accomplished. Since gas is transferred from the suction space 41 to the discharge space 42 by the movement of the transfer chamber 40, the gas pressure in the suction space 41 becomes lower than that in the discharge space 42. Gas in the transfer chamber 40 is compressed slightly and, therefore, the gas pressure in the transfer chamber 40 is an intermediate pressure that is higher than that in the suction space 41 and lower than that in the discharge space 42. Gas leaks slightly from the high-pressure discharge space 42 to the low-pressure suction space 41 through the clearance A between the rotor end surfaces 36AB, 36BB and the side wall 2G of the case 2.

In the first embodiment, the guide groove 50 (or the arcuate groove 50A and the radial groove 50B) and the communication groove 55 are formed. The state of FIG. 2 shows that the communication groove 55 at the center of the sixth pump chamber 16 faces partially and communicates with the arcuate groove 50A and the arcuate groove 50A communicates with the radial groove 50B and the transfer chamber 40. Therefore, the gas that leaks from the discharge space 42 into the clearance A between the rotor end surface 36AB and the side wall 2G is introduced into the transfer chamber 40 that is an intermediate-pressure space through, e.g., the communication groove 55 and the arcuate groove 50A, as indicated by arrow D in FIG. 2. The gas introduced into the transfer chamber 40 on the rotor 36A side of the sixth pump chamber 16 is transferred toward the discharge space 42 with the gas that has been transferred into the transfer chamber 40 from the suction space 41, as shown in FIG. 4.

On the rotor 36B side of the sixth pump chamber 16 in the state of FIG. 2, on the other hand, the gas that leaks into the clearance A between the rotor end surface 36BB and the side wall 2G is drawn by the gas flowing in arrow D direction in FIG. 2, so that part of the gas is introduced into the transfer chamber 40 on the rotor 36A side of the sixth pump chamber 16, while another part of the gas is flowed through the communication groove 55 on the rotor 36B side of the sixth pump chamber 16 and the guide groove 50 (or the arcuate groove 50A and the radial groove 50B) as indicated by arrow E in FIG. 2. At this time, no transfer chamber 40 is formed on the rotor 36B side and, therefore, no fluid communication is established between the radial groove 50B on the rotor 36B side and the transfer chamber 40. The gas flown into the guide groove 50 and the communication groove 55 is temporarily stored in such grooves due to the labyrinth effect. Immediately after a transfer chamber 40 is formed on the rotor 36B side as shown in FIG. 3 in accordance with the rotation of the rotor 36B, the radial groove 50B communicates with the transfer chamber 40 and the gas flowing through the clearance A and the gas stored in the guide groove 50 and the communication groove 55 are introduced into the transfer chamber 40. Subsequently, the gas that is introduced into the transfer chamber 40 is carried thereby and discharged into the discharge space 42 when the transfer chamber 40 is brought into communication with the discharge space 42.

Referring to FIG. 3, the dimensions of the rotor 36B and the guide groove 50 are determined so that the radial groove 50B communicates with the transfer chamber 40 after a transfer chamber 40 is formed on the rotor 36B side of the sixth pump chamber 16. In the state of FIG. 3, the transfer chamber 40 on the rotor 36A side of the sixth pump chamber 16 is just about to communicate with the discharge space 42. The entire radial groove 50B faces the lobe of the rotor 36A before the transfer chamber 40 on the rotor 36A side of the sixth pump chamber 16 communicates with the discharge space 42 and, therefore, the communication between the guide groove 50 and the transfer chamber 40 can be prevented.

The first embodiment of the present invention offers the following advantageous effects.

(1) The guide groove 50 (or the arcuate groove 50A and the radial groove 50B) that is formed on the side wall 2G allows the gas leaking through the clearance A to be introduced into the transfer chamber 40 through the guide groove 50. Therefore, the gas leakage from the discharge space 42 into the suction space 41 through the clearance A can be reduced.

(2) The communication grooves 55 that are formed on the rotor end surfaces 36AB, 36BB for communicating with the guide groove 50 allows the gas leaking through the clearance A to be collected over a wide range in a direction perpendicular to the axial direction of the rotary shafts 8A, 8B and introduced into the transfer chamber 40.

(3) After the communication between the radial groove 50B and the transfer chamber 40 is shut, the transfer chamber 40 communicates with the discharge space 42. Therefore, gas is not introduced from the discharge space 42 into the clearance A through the radial groove 50B and the arcuate groove 50A, thereby preventing gas leakage from increasing.

(4) Since the radial groove 50B communicates with the transfer chamber 40 after the transfer chamber 40 is formed, gas leakage through the guide groove 50 to the suction space 41 is prevented.

(5) The guide groove 50 that has the arcuate groove 50A and the radial groove 50B allows gas flowing near the rotary shafts 8A, 8B to be introduced into the transfer chamber 40.

(6) The communication grooves 55 that are formed at the center of the respective lobes of the rotors 36 so as to extend radially from positions adjacent to the axes of the respective rotary shafts 8A, 8B help to maintain the strength of the rotor.

(7) The provision of the guide groove 50 and the communication groove 55 can prevent gas from leaking to the suction space 41 through the clearance A due to the labyrinth effect even when the guide groove 50 is not in communication with the transfer chamber 40.

Figure 6:
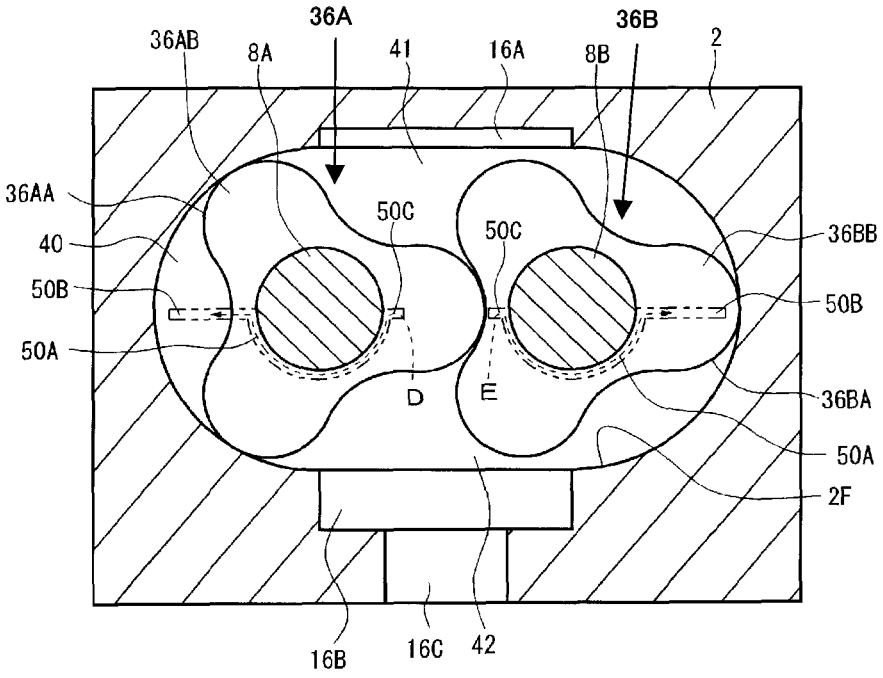
FIG. 6 is a cross-sectional view of a roots type pump according to a second embodiment of the present invention.

The following will describe the roots type pump according to the second embodiment of the present invention. Referring to FIG. 6, the roots type pump according to the second embodiment differs from that according to the first embodiment in that the communication groove 55 is dispensed with and instead a center groove 50C is provided in addition to the arcuate groove 50A and the radial groove 50B. The following description will use the same reference numerals for the common elements or components in the first and the second embodiments. The center groove 50C is formed in the side wall 2G in the center of the sixth pump chamber 16 so as to connect with an end of the arcuate groove 50A for communication therewith. The center grooves 50C are formed extending radially from the outer peripheries of the respective rotary shafts 8A, 8B and opposite from the radial groove 50B. The length of the center grooves 50C is designed so that the entire center grooves 50C always face the respective rotor end surfaces 36AB, 36BB. In other words, the center grooves 50C are formed with such a length that the entire center grooves 50C are located within the circles that are described by the innermost point of the outer periphery of the respective rotor end surfaces 36AB, 36BB when the rotors 36A, 36B are rotated.

Figure 7:
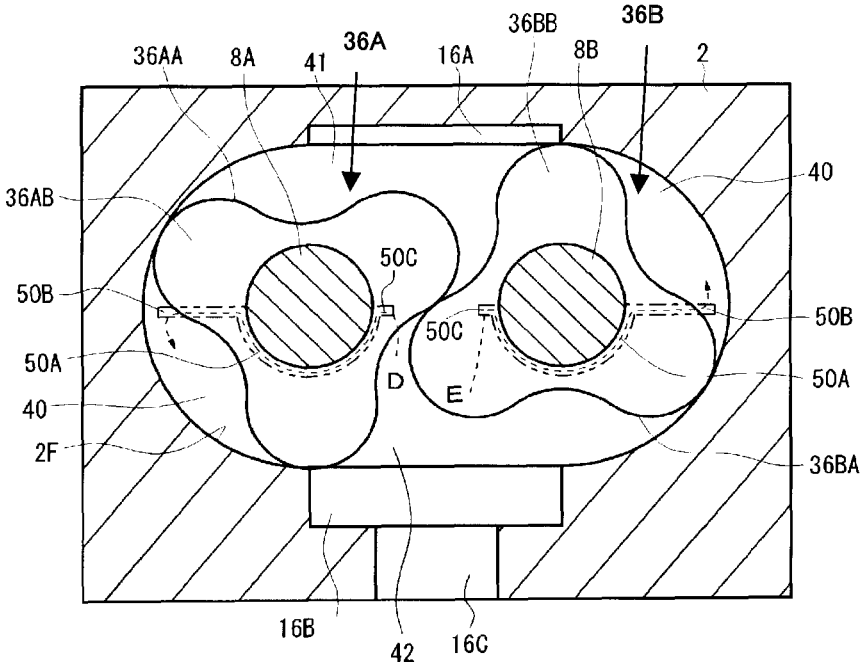
FIG. 7 is a cross-sectional view showing a state of the roots type pump after the rotor 36 has rotated 30 degrees from the state of FIG. 6.
Figure 8:
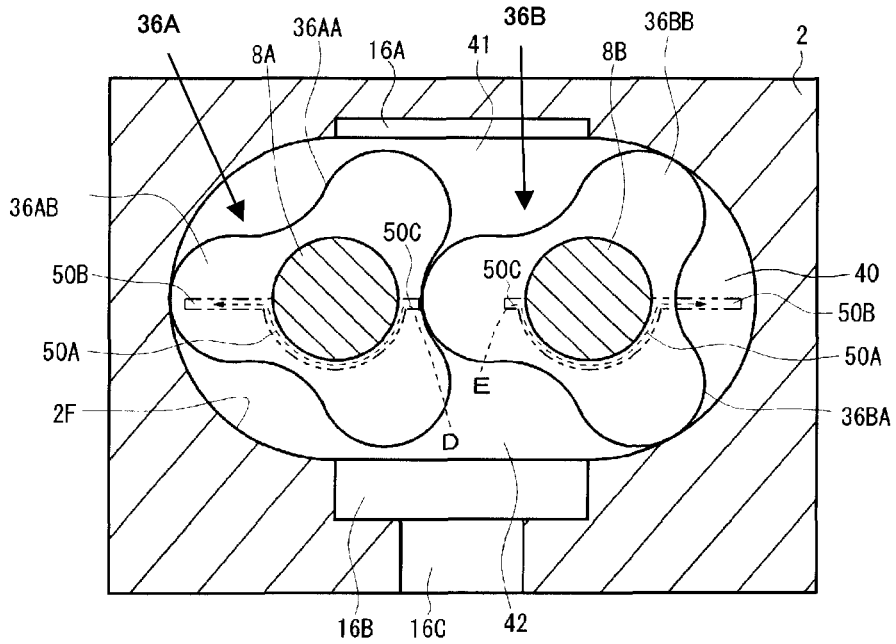
FIG. 8 is a cross-sectional view showing a state of the roots type pump after the rotor 36 has rotated 60 degrees from the state of FIG. 6.
Figure 9:
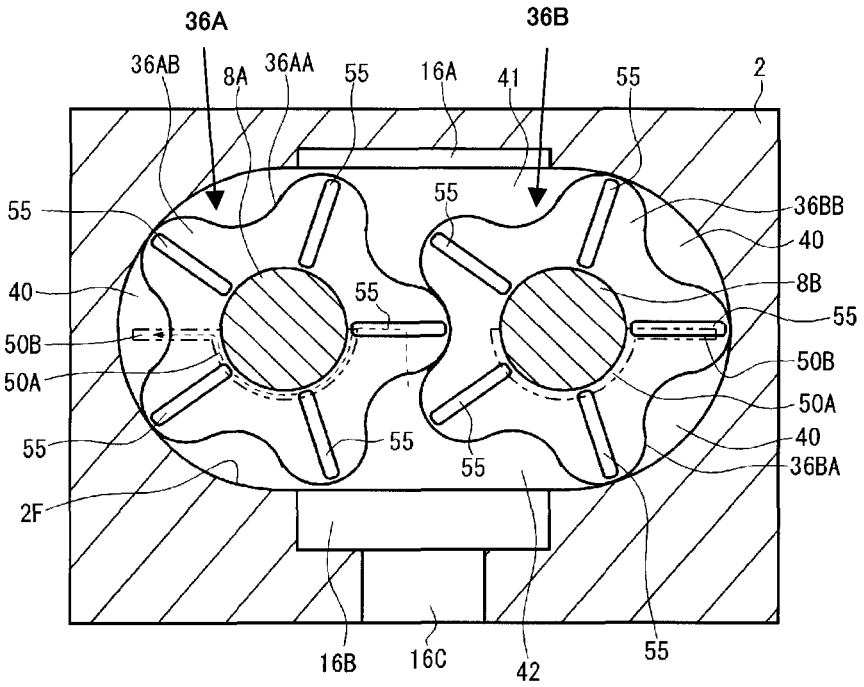
FIG. 9 is a cross-sectional view of a roots type pump having a five-lobe rotor according to an alternative embodiment of the present invention.
Figure 10:
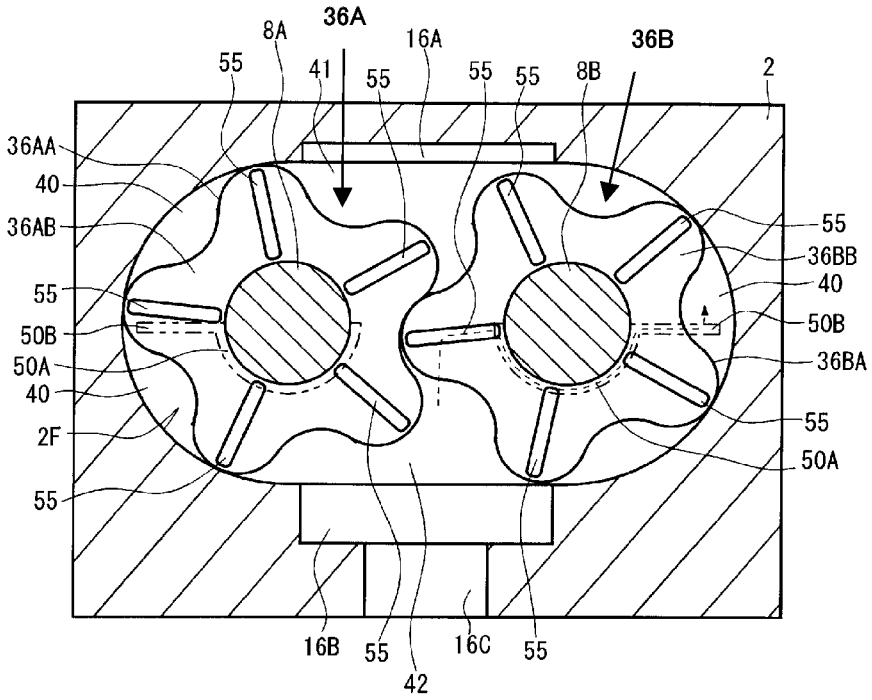
FIG. 10 is a cross-sectional view showing a state of the roots type pump after the rotor 36 has rotated 30 degrees from the state of FIG. 9.
Figure 11:
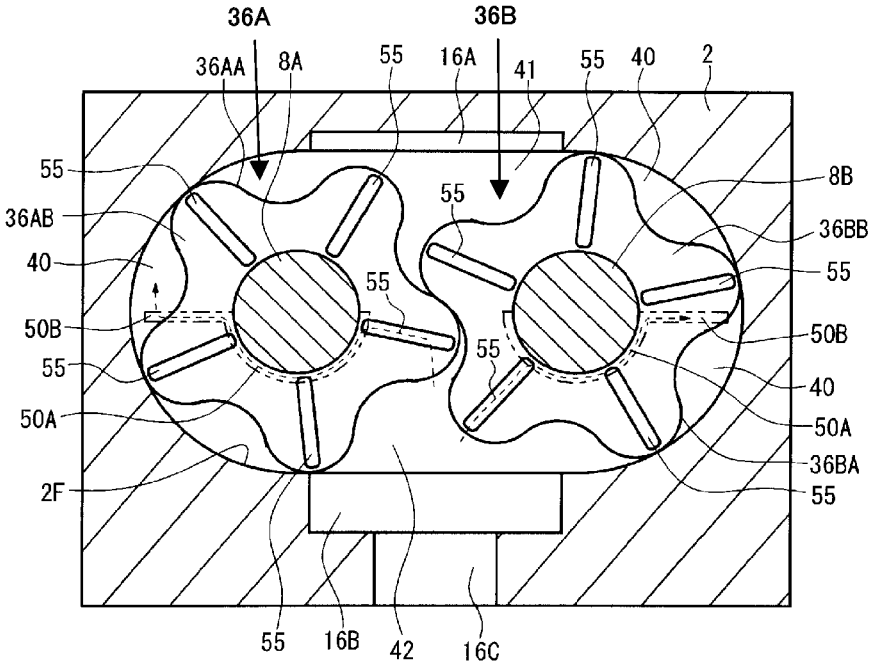
FIG. 11 is a cross-sectional view showing a state of the roots type pump after the rotor 36 has rotated 60 degrees from the state of FIG. 9.
Figure 12:
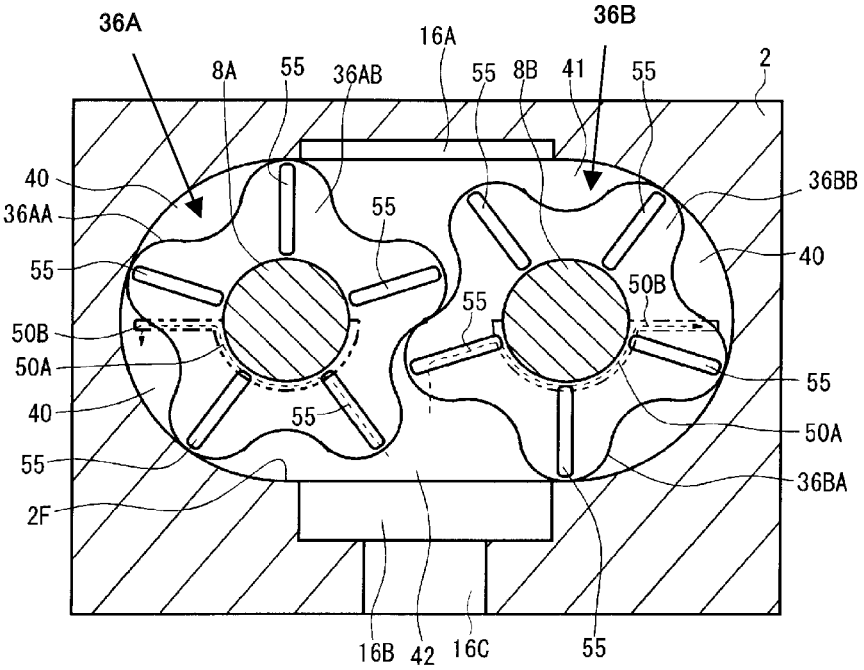
FIG. 12 is a cross-sectional view showing a state of the roots type pump after the rotor 36 has rotated 90 degrees from the state of FIG. 9.

The following will describe how the reduction of the gas leakage through the clearance A in the sixth pump chamber 16 is accomplished with reference to FIGS. 6-8.

The rotors 36A, 36B rotate synchronously and a transfer chamber 40 is formed thereby to transfer gas from the suction space 41 to the discharge space 42. Gas leaks slightly from the high-pressure discharge space 42 toward the low-pressure suction space 41 through the clearance A formed between the rotor end surfaces 36AB, 36BB and the side wall 2G. The gas that leaks from the discharge space 42 into the clearance A is introduced into the arcuate groove 50A or the center groove 50C and subsequently to the radial groove 50B. In the state of FIG. 6 wherein a transfer chamber 40 is formed on the rotor 36A side of the sixth pump chamber 16, the gas in the radial groove 50B is introduced into the transfer chamber 40, as indicated by arrow D. On the rotor 36B side of the sixth pump chamber 16, on the other hand, the radial groove 50B is not yet to communicate with a transfer chamber 40 and, therefore, a part of the gas is introduced into the transfer chamber 40 on the rotor 36A side and another part of the gas is temporarily kept in the radial groove 50B, the arcuate groove 50A and the center groove 50C on the rotor 36B side, as indicated by arrow E.

When the rotors 36A, 36B rotate 30 degrees from the state shown in FIG. 6 to the state shown in FIG. 7, a transfer chamber 40 is formed on the rotor 36B side, so that the radial groove 50B communicates with the transfer chamber 40 and part of the gas in the clearance A is introduced into the transfer chamber 40. When the rotors 36A, 36B rotate further 30 degrees from the state shown in FIG. 7 to the state shown in FIG. 8, the communication between the radial groove 50B on the rotor 36A side and the transfer chamber 40 is prevented and subsequently the transfer chamber 40 communicates with the discharge space 42, with the result that the gas introduced from the clearance A into the radial groove 50B returns to the discharge space 42.

The second embodiment of the present invention offers the following advantageous effects in addition to the advantageous effects (1), (3), (4), (5) offered by the first embodiment.

(8) The provision of the center groove 50C allows gas to be introduced from the center of the sixth pump chamber 16 into the transfer chamber 40 without using the communication groove 55 according to the first embodiment.

(9) The provision of the guide groove 50 offers a labyrinth effect that prevents the gas from leaking from the clearance A into the suction space 41 when the guide groove 50 is not in communication with the transfer chamber 40.

The above embodiments may be modified as follows.

Figure 13:
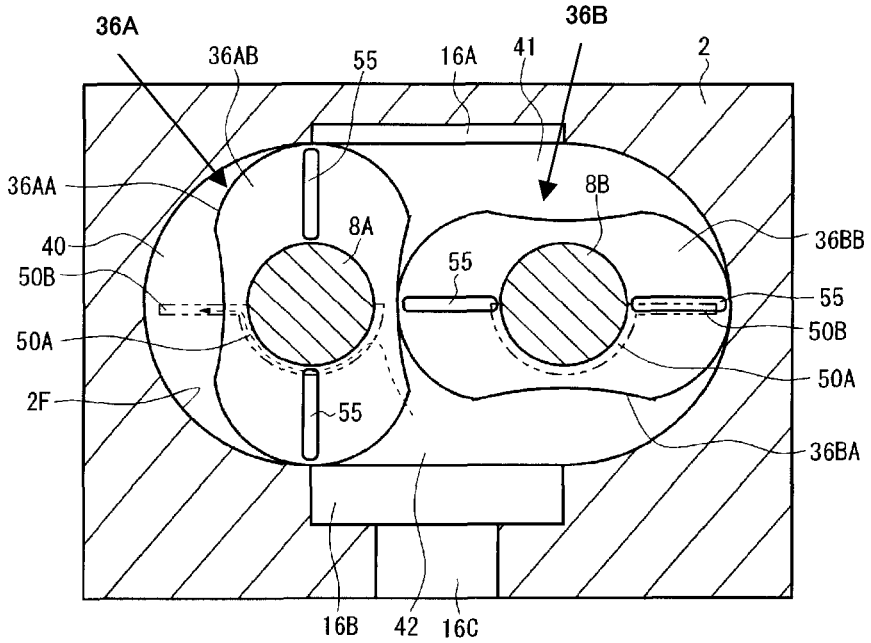
FIG. 13 is a cross-sectional view of a roots type pump having a two-lobe rotor according to another alternative embodiment of the present invention.
Figure 14:
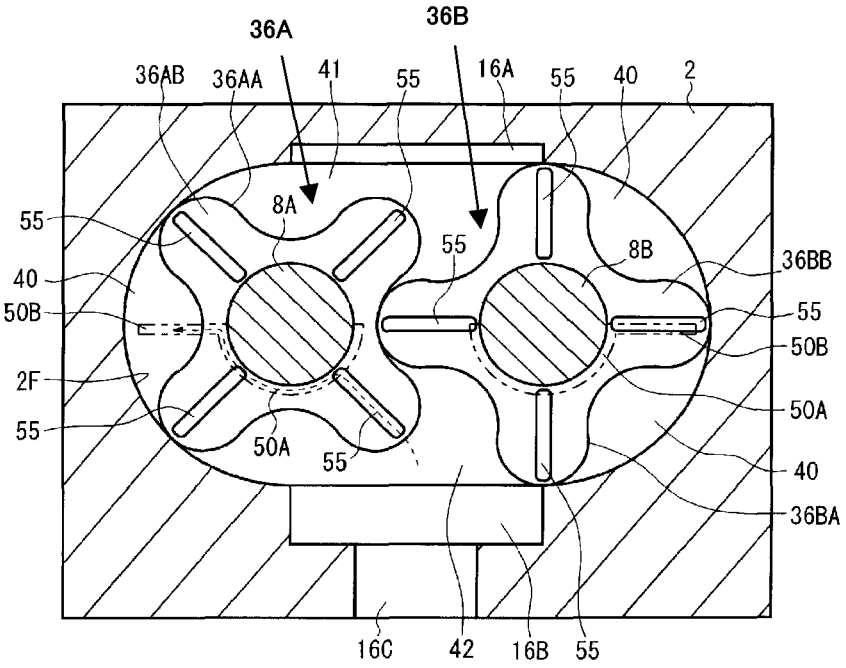
FIG. 14 is a cross-sectional view of a roots type pump having a four-love rotor according to still another alternative embodiment of the present invention.

The rotor 36 has three lobes in the above embodiments, but the rotor may have five lobes as shown in FIGS. 9-12. In this case, the communication groove 55 formed in the respective lobes and the guide groove 50 (or the arcuate groove 50A and the radial groove 50B) also allow gas leaking into the clearance A to flow into the transfer chamber 40. The rotor may have two lobes as shown in FIG. 13 or four lobes as shown in FIG. 14.

A six stage roots pump is employed in the above embodiments, but the present invention is not limited to the six stage roots pump. A single stage or any multistage roots pump other than six stage roots pump may be employed. The present invention is applicable to a vacuum pump and a blower.

In the above embodiments, the guide groove 50 is formed below the axes of the rotary shafts 8A, 8B on the discharge space 42 side of the sixth pump chamber 16, but it may be formed on the suction space 41 side of the sixth pump chamber 16. The cross-sectional shape of the guide groove 50 may be rectangular, but it is not limited to a specific shape.

In the above embodiments, the communication groove 55 is formed radially in the center of the lobe, but it may be formed anywhere other than the center of the lobe. A plurality of communication grooves may be formed in the lobe. The width and the depth of the communication groove 55 are not limited to any specific dimensions. The width and the depth of the communication groove 55 may be formed so as to be enlarged toward the axis of the rotary shaft.

The shape of the rotor 36 is not limited to those which have been shown or described in the above embodiments. The curvature of the lobe and the end shape of the lobe may be determined as required and the shapes of the guide groove and the communication groove may be determined in accordance with the shape or profile of the rotor.

What is claimed:

1. A roots fluid machine comprising:

a case having a side wall;

a pair of rotary shafts provided in the case;

a pair of rotors engaged with each other and fixed to the pair of rotary shafts so as to extend axially, respectively, at least one of the pair of rotors having a rotor end surface, wherein a clearance is formed between the side wall and the rotor end surface;

a suction space formed by the case and the pair of rotors for introducing fluid;

a discharge space formed by the case and the pair of rotors for discharging fluid; and a transfer chamber formed by the case and the at least one of the pair of rotors, the transfer chamber transferring fluid introduced in the suction space to the discharge space in accordance with the rotation of the pair of rotors, wherein the case has a guide groove formed in the side wall facing the rotor end surface, wherein the guide groove through which fluid leaked from the discharge space into the clearance is introduced into the transfer chamber, wherein the at least one of the pair of rotors has a communication groove that is formed in the rotor end surface and communicable with the guide groove.

2. The roots fluid machine according to claim 1, wherein the guide groove is formed so as to communicate with the transfer chamber.

3. The roots fluid machine according to claim 1, wherein the guide groove is formed so that the communication between the guide groove and the transfer chamber is prevented before the transfer chamber communicates with the discharge space.

4. The roots fluid machine according to claim 1, wherein the communication groove is formed so as to extend radially from the axis at least one of the pair of rotary shafts.

5. The roots fluid machine according to claim 1, wherein the at least one of the pair of rotors has a plurality of lobes, wherein the communication groove is formed at the center of the lobe.

6. The roots fluid machine according to claim 1, wherein the guide groove includes:

an arcuate groove formed along outer periphery of the at least one of the pair of rotary shafts; and a radial groove extending from the outer periphery of the at least one of the pair of rotary shafts and connected to one end of the arcuate groove, the radial groove communicating with the transfer chamber in accordance with the rotation of the at least one of the pair of rotors.

7. The roots fluid machine according to claim 6, wherein the guide groove further includes:

a center groove communicating with the other end of the arcuate groove and extending radially from the outer periphery of the at least one of the pair of rotary shafts and opposite from the radial groove, the length of the center groove being designed so that the entire center groove always face the rotor end surface when the at least one of the pair of rotors is rotated.

* * * * *